United States Patent [19]

Yang

[11] Patent Number: 4,553,083

[45] Date of Patent: Nov. 12, 1985

[54] BANDGAP REFERENCE VOLTAGE GENERATOR WITH $V_{CC}$ COMPENSATION

[75] Inventor: Tsen-Shau Yang, San Jose, Calif.

[73] Assignee: Advanced Micro Devices, Inc., Sunnyvale, Calif.

[21] Appl. No.: 556,770

[22] Filed: Dec. 1, 1983

[51] Int. Cl.[4] ..... G05F 3/20

[52] U.S. Cl. ..... 323/313; 323/299; 323/907

[58] Field of Search ..... 323/299, 313, 314, 315, 323/316, 907; 307/296 R, 297, 310

[56] References Cited

U.S. PATENT DOCUMENTS

| | | | |
|---|---|---|---|
| 4,079,308 | 3/1978 | Brown | 323/314 |
| 4,100,477 | 7/1978 | Tam | 323/314 |
| 4,100,478 | 7/1978 | Tam | 323/314 |
| 4,189,671 | 2/1980 | Yuen | 323/314 |
| 4,277,739 | 7/1981 | Priel | 323/314 X |

OTHER PUBLICATIONS

A. H. Seidman, "Integrated Circuits Applications Handbook", (Wiley, 1983), pp. 498–499.

D. A. Hodges, et al., "Analysis and Design of Digital Integrated Circuits", (McGraw-Hill, 1983), pp. 271–283.

*Primary Examiner*—Peter S. Wong

*Attorney, Agent, or Firm*—Patrick T. King; J. Vincent Tortolano

[57] ABSTRACT

A bandgap reference voltage generator includes compensation circuitry that renders the performance of the bandgap reference voltage generator independent of the static value of the supply voltage, $V_{CC}$ by providing a constant current through the self-regulating loop in the generator. The compensation circuitry effectively provides compensating terms for each $V_{CC}$-dependent term in the network equation that describes the operation of the bandgap reference voltage generator. In a preferred embodiment, the compensating terms also serve to make the operation of the bandgap voltage generator independent of temperature.

8 Claims, 3 Drawing Figures

BANDGAP REFERENCE VOLTAGE GENERATOR WITH $V_{CC}$ COMPENSATION

BACKGROUND OF THE INVENTION

1. Field of the Invention

This invention relates to an improved bandgap reference voltage generator and, more particularly, relates to a bandgap reference voltage generator whose operation is compensated to produce an output reference voltage that is independent of variations in supply voltage, $V_{CC}$.

2. Discussion of Background and Prior Art

Emitter-coupled logic (ECL) is a widely utilized logic family for high performance products. ECL has the shortest propagation delay of any logic form. With ECL logic, superior comparator functions and high-speed analog-to-digital conversion may be accomplished. ECL logic is utilized in such diverse applications as instrumentation, computers, phase-array radar, telecommunication systems, and a host of modern electronics applications where high performance is required or desired. It is important to preserve this high performance potential when ECL circuits are designed and fabricated.

To ensure that integrated circuits embodying ECL logic achieve maximum performance, a bandgap reference voltage is commonly generated on-chip and is used to control the base of the main current source transistor that establishes the magnitude of the current that flows either through a reference transistor or that flows both through a reference transistor and through input transistors. The bandgap reference voltage, designated $V_{REF}$ or $V_{CS}$, has the characteristic that it is stable and that it tracks variations in processing and changes in operating parameters such as temperature. See, e.g., *Integrated Circuits Applications Handbook,* ed. A. H. Seidman pp. 498–499 (1983). See also D. A. Hodges, et al, *Analysis and Design of Digital Integrated Circuits,* pp. 271–283 (McGraw-Hill 1983). In ECL circuits a reference voltage $V_{BB}$ is also generated from $V_{CS}$ and supplied to the gate of the reference transistor in order to establish the threshold level for the recognition of a high digital logic state.

The supply voltage, $V_{CC}$, is generated externally and introduced to a packaged circuit through a dedicated pin. For ECL circuits an externally supplied $V_{CC}$ is specified as being acceptable if it lies within a range from about 4.5 volts to about 5.5 volts. Thus, an external power supply may provide a voltage anywhere within this range and the integrated circuit will function properly. Since the supply voltage $V_{CC}$ is used to provide power to the internal bandgap reference voltage generator as well as to all other circuit elements, this generator must be able to operate properly over values for $V_{CC}$ within this range. In practice it has been found that the operation of conventional bandgap voltage generators is dependent upon the static value for $V_{CC}$, i.e., upon the baseline value for $V_{CC}$ without taking transients into account. Thus, in a DC or static sense $V_{CS}$ is dependent on $V_{CC}$. If $V_{CS}$ varies, the total chip current, $I_{CC}$, will vary, the logic swing will vary and the main current source transistor may saturate (transistor 60 in FIG. 3). If $I_{CC}$ varies then the design of the integrated circuit is made more difficult and its operation less reliable. If the logic swing is too high then the input transistor on the ECL differential pair may saturate; if the logic swing is too low then noise margins are reduced.

It would be highly desirable to provide a bandgap reference voltage generator whose $V_{CS}$ output is independent of the static value for $V_{CC}$ over the allowable range for $V_{CC}$. In addition, even for a supply voltage $V_{CC}$ having a value precisely in the center of the allowable voltage range or for a supply voltage which stays precisely at any particular allowable value there will be transients in the supply voltage $V_{CC}$ due to instabilities in the power supply and to transient currents induced by switching on the output of associated logic gates. These transients will typically penetrate through the bandgap reference voltage generator and alter the instantaneous value for $V_{CS}$. Thus, in an AC or transient sense $V_{CS}$ is dependent on $V_{CC}$. These variations are highly undesirable on large integrated circuits as they are likely to occur unevenly across the chip thereby producing perturbations in overall circuit performance. It would be desirable to make the instantaneous value for $V_{CS}$ immune to such transients. And, $V_{CS}$ will vary over temperature, an undesirable feature for a supposedly stable reference voltage generator. It would also be desirable to generate a bandgap reference voltage $V_{CS}$ with no temperature dependence.

It is therefore an object of the present invention to provide a bandgap reference voltage generator which includes compensation circuitry to thereby produce a stable reference voltage, $V_{REF}$, over the allowable range of operation for supply voltage, $V_{CC}$.

It is another object of the present invention to provide a bandgap reference voltage generator in which transients from $V_{CC}$ do not couple through the bandgap reference voltage generator to $V_{CS}$.

And it is an additional object of the present invention to provide a bandgap reference voltage generator for which $V_{CS}$ is not dependent on temperature.

BRIEF DESCRIPTION OF THE DRAWINGS

For a more complete understanding of the compensated bandgap reference voltage generator of the present invention, reference may be had to the accompanying drawings which are incorporated herein by reference and in which.

SUMMARY OF THE INVENTION

A bandage reference voltage generator is provided which includes compensation circuitry that renders the performance of the bandgap reference voltage generator independent of the static value of the supply voltage $V_{CC}$. The compensation circuitry produces a constant current through the self-regulating loop in the generator thereby providing a compensating term for each $V_{CC}$-dependent term, and preferably each temperature-dependent term, in the network equation which describes the operation of the bandgap reference voltage generator.

DESCRIPTION OF THE PREFERRED EMBODIMENT

Figure 1:
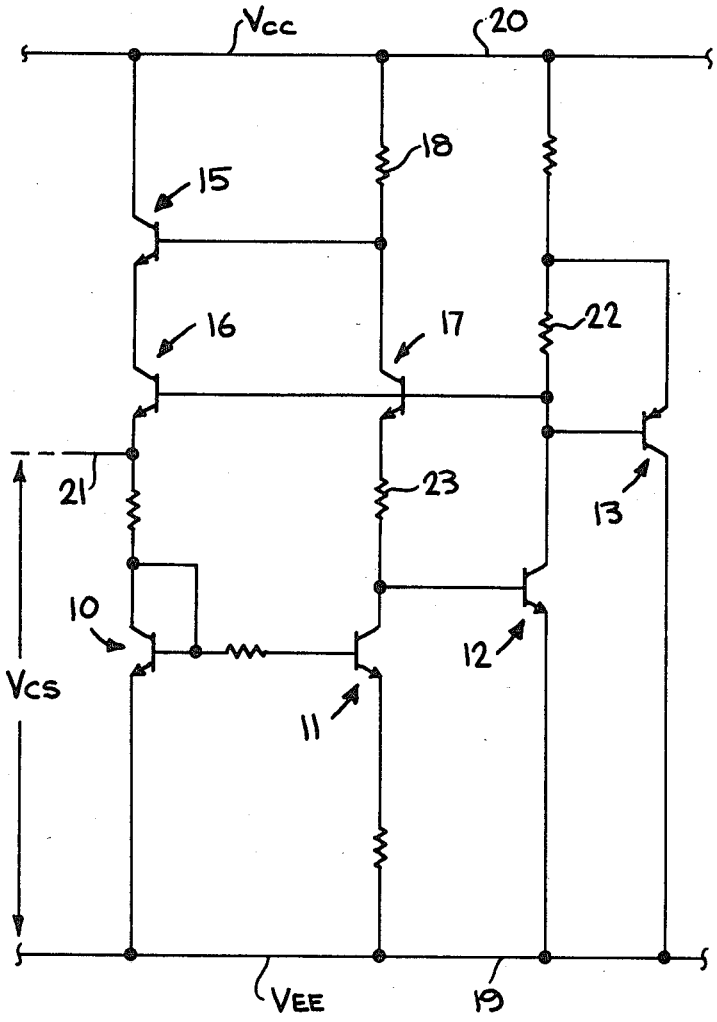
FIG. 1 (PRIOR ART)
FIG. 1 is a schematic diagram of a compensated bandgap reference voltage generator of the prior art.

The object of conventional bandgap reference voltage generators are typically dependent upon both supply voltage $V_{CC}$ and temperature. See, for example, the simplified bandgap reference shown as FIG. 15.9 on p. 499 of *Integrated Circuits Applications Handbook, ed. A. H. Seidman (McGraw-Hill* 1983). In order to avoid the problems discussed in the Background section above, attempts have been made to design bandgap reference voltage generators whose output, $V_{CS}$, is independent of supply voltage, $V_{CC}$. Such an attempt is shown in D. H. Hodges et al, *Analysis and Design of Digital Integrated Circuits,* pp. 279–283 (McGraw-Hill 1983) and in FIG. 1. The bandgap reference voltage, $V_{CS}$, is derived, as shown in FIG. 1, between the $V_{EE}$ potential line 19 and line 21 which is connected to the emitter of transistor 16. This bandgap reference voltage generator is supposedly compensated. In theory, because of the shunt regulator 13 the collector current of transistor 12 is held constant, even as $V_{EE}$ is changed with respect to $V_{CC}$, i.e., as the supply voltage $V_{CC}$ varies. If the current through transistor 12 should tend to increase, due to changes in $V_{CC}$, the voltage drop across resistor 22 would increase, thereby causing shunt regulator 13 to conduct increased current thereby shunting current away from transistor 12 through transistor 13. As a consequence, changes in the supply voltage, $V_{CC}$, have no effect on the collector currents of transistors 10, 11 and 12. Since there is no change in the current through transistor 12, $V_{BE12}$ does not change. Also, with no change in the current through transistor 11 there is no change in the voltages across resistor 23 or resistor 18. The result is that $V_{CS}$ is insensitive to changes in the supply voltage. However, this insensitivity can only be designed at a single temperature since the collector current of transistor 12 varies over the temperature.

$$I_{12} = -\frac{V_{BE13}}{R_{22}}$$

Because $V_{BE13}$ varies over the temperature range, therefore $I_{12}$ also varies over the temperature range. Also, the above circuit requires the use of a PNP transistor which requires a larger area than an NPN transistor and is more difficult to fabricate with specified characteristics.

Another attempt at reference voltage generation with $V_{CC}$ independence and with partial temperature compensation is shown in U. Priel, "Fixed Voltage Reference Circuit", U.S. Pat. No. 4,277,739. Here, two output voltages are made substantially independent of power supply voltage variations by regulating the voltage supplied to resistor 22 and the principal transistor (transistor 12, FIG. 1) of the bandgap voltage regulator. This is accomplished by stacking another bandgap voltage generator onto the principal bandgap voltage generator. By adjusting the ratios of certain transistors, either a positive or negative temperature coefficient can be designed into the circuit. If a zero temperature coefficient is chosen, the output of the principal bandgap voltage generator can be made temperature independent. The disadvantages of this circuit are that capacitors are required for the added bandgap-like voltage generator—an undesirable addition to an integrated circuit; a second $\Delta V_{BE}$ generator is required entailing the use of large area transistors; and a potential imbalance is introduced between the two branches of the principal bandgap voltage regulator and the added $V_{BE}$ generator due to the second order base current effect. Also there is no active feedback between the voltage reference output and the bandgap voltage generator.

Figure 2:
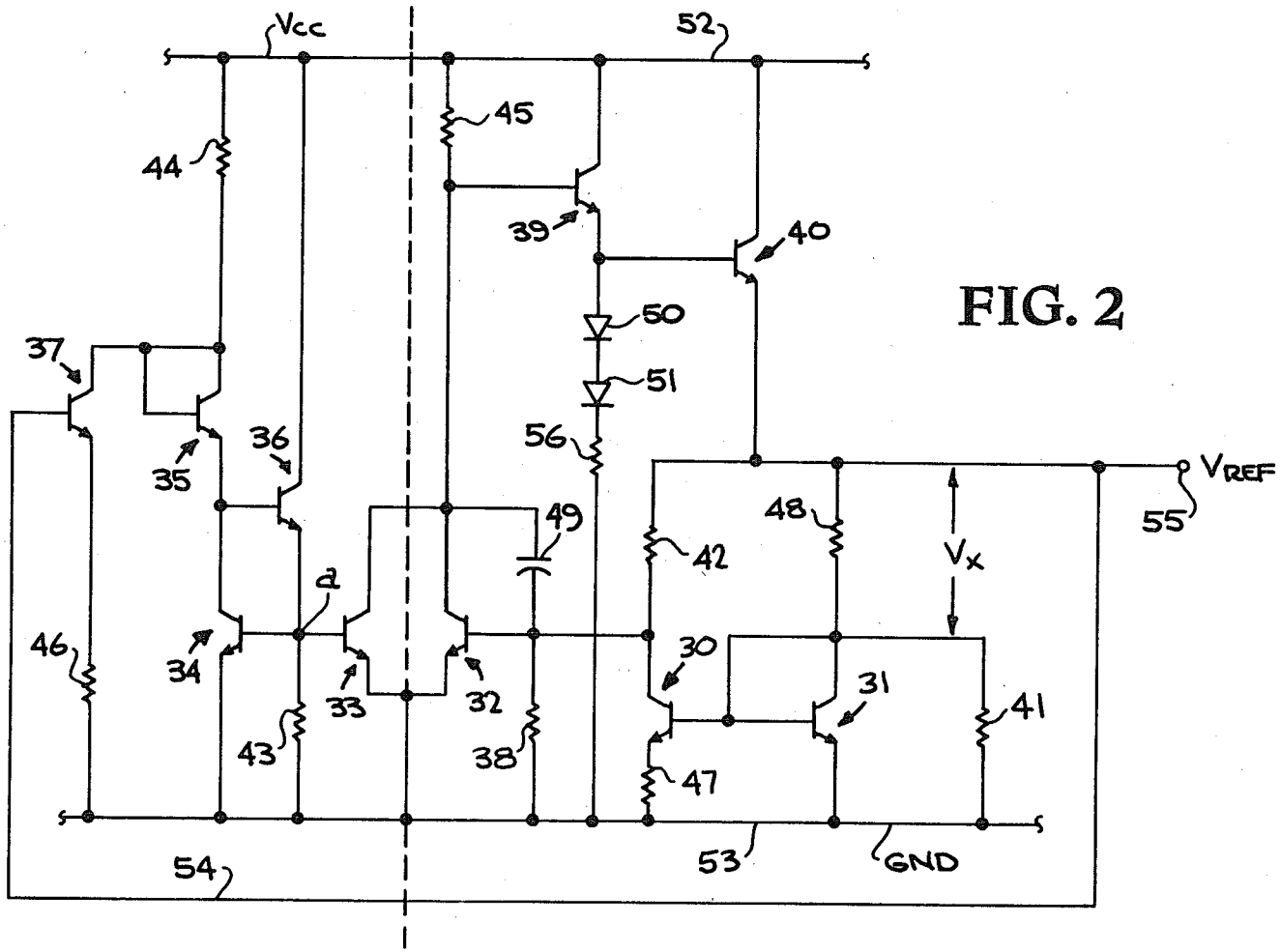
FIG. 2 is a schematic diagram of the compensated bandgap reference voltage generator of the present invention.
Figure 3:
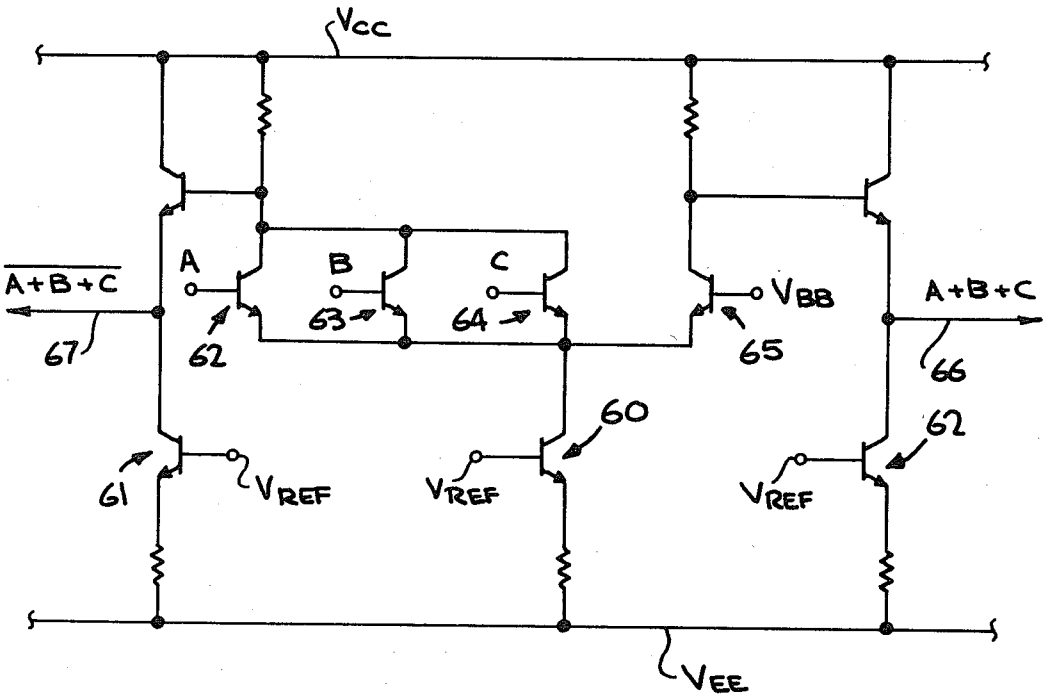
FIG. 3 (PRIOR ART)
FIG. 3 is a schematic diagram of a typical ECL OR/-NOR gate circuit which employs the bandgap reference to control current through the main current source transistor 60 as well as the current through pulldown transistors 61 and 62.

The bandgap reference voltage generator of the present invention accomplishes $V_{CC}$ independence by producing a constant current in transistor 32 of the self-regulating loop consisting of current source resistor 45, transistors 39 and 40, resistor 42 and transistor 32. In normal operation, $V_{REF}$ is partially isolated from changes in $V_{CC}$ by this self-regulating loop. With the present invention the current through transistor 32 is regulated to be constant so that the output voltage, $V_{REF}$, remains constant over changes in $V_{CC}$ and temperature. In FIG. 2 all circuit elements to the right of the dotted vertical line passing between emitter-coupled transistors 33 and 32 make up a bandgap reference voltage generator of the type disclosed in G. W. Brown, "Resistor Ratio Circuit Construction", U.S. Pat. No. 4,079,308. All circuit elements to the left of the dotted line are included in the compensation circuit. Each of the prior art bandgap reference generators discussed above as well as the bandgap reference generator of FIG. 2 can be described by a unique network equation. In each set of network equations there will be $V_{CC}$-dependent terms. Typically, there will also be temperature-dependent terms. The present invention employs a circuit element in the compensation portion of the circuit to compensate for each of the $V_{CC}$-dependent terms so that the output voltage, $V_{REF}$, has no $V_{CC}$ dependence. In a preferred embodiment the compensation for $V_{CC}$ also produces compensation at all temperatures. In the prior art, as described in detail above, $V_{CC}$ dependence has either only been by nonoptimum circuitry, has only been partially achieved or has not held for all temperatures.

The network equations which describe the operation of the bandgap reference voltage generator of FIG. 2, shown to the right of the dotted line, are as follows:

$$V_{REF} = V_{R42} + V_{BE32}$$

$$I_{C31} = \frac{V_{REF} - V_{BE31}}{R_{48}} - \frac{V_{BE31}}{R_{41}}$$

$$I_{C30} = \frac{V_{REF} - V_{BE32}}{R_{42}} - \frac{V_{BE32}}{R_{38}}$$

where $V_K$ = voltage across K'th circuit element $I_J$ = current through specified portion of J'th circuit element, i.e., $I_{C31}$ = the collector current of transistor 31.

Now if $$V_{BE31} = V_{BE32}$$

and $$\frac{R_{48}}{R_{42}} = \frac{R_{41}}{R_{38}}$$

then $$I_{C31}/I_{C30} = \frac{R_{42}}{R_{48}}$$

Now $$V_{R47} = V_{BE31} - V_{BE30} = \frac{kT}{q} \ln\left(\frac{I_{C31} A_{30}}{I_{C30} A_{31}}\right) = \frac{kT}{q} \ln\left(\frac{R_{42} A_{30}}{R_{48} A_{31}}\right)$$

where $A_L$=area of the L'th transistor.

Since $I_{R42} = I_{C30} + I_{R38}$ $$= \frac{V_{R47}}{R_{47}} + \frac{V_{BE32}}{R_{38}}$$

$$= \frac{kT}{q} \ln\left(\frac{R_{42}}{R_{48}} \cdot \frac{A_{30}}{A_{31}}\right) \cdot \frac{1}{R_{47}} + \frac{V_{BE32}}{R_{38}}$$

$$V_{R42} = R_{42} \cdot I_{R42}$$

$$= \frac{R_{42}}{R_{47}} \cdot \frac{kT}{q} \ln\left(\frac{R_{42}}{R_{48}} \cdot \frac{A_{30}}{A_{31}}\right) + \frac{R_{42}}{R_{38}} \cdot V_{BE32}$$

The first term defining $V_{R42}$ has a positive temperature coefficient whereas the second term has a negative temperature coefficient. Therefore by adjusting the ratios $R_{42}/R_{47}$, $R_{42}/R_{48}$, $A_{30}/A_{31}$, or $R_{42}/R_{38}$, $R_{38}$ $V_{REF}$ can be designed to have a desired temperature coefficient. Preferably, the $V_{REF}$ in an ECL circuit application will have the value of $$V_{BE}+V_x$$

where $V_x$ has a zero temperature coefficient. This will be accomplished by making $$\frac{\partial V_{R42}}{\partial T} = 0 = \frac{R_{42}}{R_{47}} \frac{k}{q} \ln\left(\frac{R_{42}}{R_{48}} \cdot \frac{A_{30}}{A_{31}}\right) + \frac{R_{42}}{R_{38}} \cdot \frac{\partial V_{BE32}}{\partial T}$$

For the above derivation, the equality of the ratio of $R_{48}/R_{41}$ to $R_{42}/R_{38}$ and the relationship $V_{BE31}=V_{BE32}$ holds over the operational temperature range of the bandgap generator. The relationship $R_{48}/R_{41}=R_{42}/R_{38}$ is easily accomplished in integrated circuits. However, the value for $V_{BE32}$ is basically dependent on $V_{CC}$ as seen in the following equation for a stand-alone bandgap reference voltage generator where no compensation network is used:

$$I_{C32} = \frac{V_{CC} - V_{REF} - V_{BE39} - V_{BE40}}{R_{45}}$$

And $$V_{BE32} = \frac{kT}{q} \ln\left(\frac{I_{C32}}{I_{S32}}\right)$$

-continued $$= \frac{kT}{q} \ln\left(\frac{V_{CC} - V_{REF} - V_{BE39} - V_{BE40}}{R_{45} \cdot I_{S32}}\right)$$

where $I_{S32}$=saturation current for transistor 32. Thus, it can be seen that in order to obtain a constant $V_{REF}$ output at terminal 55 a constant current needs to be maintained through constant current transistor 32; therefore, transistor 32 is hereinafter designated as the constant current transistor. This is accomplished in the prior art by regulating the voltage, as described above for U. Priel, U.S. Pat. No. 4,277,739. In the present invention a constant current is achieved by the compensation circuitry.

The current which passes through constant current transistor 32 also passes through a current source resistor 45. Resistor 45 also passes the current supplied to transistor 33. This total current is given by $$I_{45} = \frac{V_{CC} - B_{BE32} - V_x - V_{BE40} - V_{BE39}}{R_{45}} = \frac{V_{CC} - (3V_{BE} + V_x)}{R_{45}}$$

a consolidation which is permissible since the base-to-emitter diode drops can be designed to be the same for all transistors by assuring that the current densities for the transistors are the same. $V_x$ is a constant because $V_{R42}$ can be designed to be constant in accordance with the above equations. But the term $I_{45}$ still varies both directly and indirectly with $V_{CC}$ and temperature. The compensation circuitry incorporated in the bandgap circuit of the present invention serves to ensure that the sharing of this current by transistors 33 and 32 is such that a constant current flows through constant current transistor 32 even as the current through resistor 45 changes. Thus, transistor 33 is a compensation transistor and is hereinafter designated as the compensation current transistor. Compensation transistor 33 must be driven to follow and compensate for variations in $I_{45}$. Thus, the preferred value for the collector current of transistor 32 will be $V_x/R_{45}$. Thus, in order to leave this term as a real and precise current through constant current transistor 32, it is necessary to drive compensation transistor 33 to have a current which is equal to $$I_{33} = \frac{V_{CC} - (3V_{BE} - 2V_x)}{R_{45}}$$

By subtracting $I_{33}$ from $I_{45}$ the positive current $V_x/R_{45}$ is seen to pass through constant current transistor 32.

The circuit objective of driving $I_{33}$ to the value described above could be accomplished with many specific circuits. A preferred circuit embodiment is shown to the left hand side of the dotted vertical line in FIG. 2. Here, the current through transistor 33 is controlled by the potential at node a on its base. The potential on node a is determined by two features of the circuit. First, transistor 37, hereinafter designated as the feedback transistor, has its base connected in active feedback fashion to the $V_{REF}$ output line of the bandgap reference voltage generator. The current through feedback transistor 37 is given by $$I_{37} = \frac{V_{REF} - V_{BE}}{R_{46}} = \frac{V_x}{R_{46}}$$

Now, the current through resistor 44 is given by $$I_{44} = \frac{V_{CC} - 3V_{BE}}{R_{44}}$$

And, since the current through resistor 44 is shared by feedback transistor 37 and transistor 35, the current through transistors 35 and 34 is given by $$I_{35} = I_{34} = I_{44} - I_{37}$$

If, in the above equations, the values of resistors 44, 45, and 46 are chosen such that $$R_{45} = 2R_{46} = R_{44}$$

then the current through transistor 34 is given by $$I_{34} = \frac{V_{CC} - 3V_{BE} - 2V_x}{R_{45}} = I_{33}$$

This is due to the fact that the current through transistor 34 is mirrored by the current through compensation transistor 33. As a consequence of driving the value of the current through compensation transistor 33 to the above value, the instantaneous current through constant current transistor 32 is given by $$\begin{aligned} I_{32} &= I_{45} - I_{33} \\ &= \frac{V_{CC} - 3V_{BE} - V_x}{R_{45}} - \frac{V_{CC} - 3V_{BE} - 2V_x}{R_{45}} \\ &= \frac{V_x}{R_{45}} \end{aligned}$$

It can thus be seen that the current through constant current transistor 32 will always be given by a constant term so that the value of $V_{REF}$ on output terminal 55 will be constant whatever the instantaneous value of $V_{CC}$. If should be noted that in this preferred embodiment there is also no temperature dependent term remaining.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. In a bandgap reference voltage generator for producing a stable reference voltage, $V_{REF}$, in an integrated circuit, including parallel current paths, a means for supplying current through the parallel paths and a self-regulating means for establishing a $V_{REF}$ voltage, the improvement comprising:

compensation circuitry to render the operation of the bandgap reference voltage generator independent of the supply voltage, $V_{CC}$, said compensation circuitry providing compensating terms of opposite sign for a $V_{CC}$ dependent term in one of the network equations which describe the operation of the bandgap reference voltage generator, wherein said one network equation is given by $V_{REF} = V_{R42} + V_{BE32}$, where $V_{R42}$ = voltage across a resistor 42 and $V_{BE32}$ = Base-emitter voltage of a transistor 32, and wherein $V_{BE32}$ is said $V_{CC}$ dependent term, said compensation circuitry including feedback means connected to the ends of said parallel current paths to assist in controlling the conductance of said compensation circuitry as changes in supply voltage, $V_{CC}$, occur.

2. An improved bandgap reference voltage generator in accordance with claim 1 wherein said compensating circuitry also compensates the temperature depended terms in a second of said network equations, wherein said second of said network equations is given by:

$$I_{C32} = \frac{V_{CC} - V_{REF} - V_{BE29} - V_{BE40}}{R_{45}},$$

where $I_{C32}$ = collector current of said transistor 32, $V_{BE39}$ = Base-Emitter voltage of a transistor 39, $V_{BE40}$ = Base-Emitter voltage of a transistor 40 and $R_{45}$ = Resistance of a resistor 45, and wherein $V_{BE39}$ and $V_{BE40}$ are said temperature dependent terms.

3. An improved bandgap reference voltage generator in accordance with claim 2 wherein said compensation circuitry includes a compensation transistor having its collector coupled with the collector of a constant current transistor of said bandgap reference voltage-generator and having its emitter coupled with the emitter of said constant current transistor whereby current is shared between said constant current transistor and said compensation transistor so that by varying the current through said compensation transistor as variations in supply voltage, $V_{CC}$, occur, the current through said constant current transistor remains constant.

4. An improved bandgap reference voltage generator in accordance with claim 3 wherein said compensation circuitry further includes:

a third transistor having its collector coupled to a collector of a feedback transistor of said feedback means, having its base coupled to its own collector and having its emitter coupled to the base of a fourth transistor;

said fourth transistor having its collector coupled to the supply line, $V_{CC}$, and having its emitter coupled to said base of said compensation transistor;

a fifth transistor having its collector coupled to said base of said fourth transistor, having its emitter coupled to ground and having its base coupled to said base of said compensation transistor; and a third resistor connected between the base of said compensation transistor and ground.

5. An improved bandgap reference voltage generator in accordance with claim 4 wherein the value of said current source resistor is equal to the value of said second resistor and wherein the value of said first resistor is equal to one half the value of said current source resistor.

6. An improved bandgap reference voltage generator in accordance with claim 4 wherein said means for supplying current through the parallel paths comprises a sixth transistor having its base connected to the collector of said constant current transistor, its collector connected to the $V_{CC}$ voltage supply line and a seventh transistor having its base connected to the emitter of said sixth transistor, its collector connected to the $V_{CC}$ supply line and its emitter connected to said ends of each of said series of resistors.

7. An improved bandgap reference voltage generator in accordance with claim 6 in combination with a diode and resistor string connected between the base of said seventh transistor and ground to enhance the frequency response for $V_{REF}$.

8. An improved bandgap reference voltage generator in accordance with claim 4 wherein said emitter of said second transistor is connected to ground through a resistor.

* * * * *